US006612373B2

(12) United States Patent
Brennan

(10) Patent No.: US 6,612,373 B2
(45) **Date of Patent: *Sep. 2, 2003**

(54) APPARATUS AND METHOD FOR OFF-ROAD VEHICLE FIRE PROTECTION AND FIRE SUPPRESSION

(76) Inventor: Richard P. Brennan, 106 Westwood Cir., State College, PA (US) 16803

( * ) Notice: Subject to any disclaimer, the term of this patent is extended or adjusted under 35 U.S.C. 154(b) by 0 days.

This patent is subject to a terminal disclaimer.

(21) Appl. No.: 10/051,582

(22) Filed: Jan. 17, 2002

(65) Prior Publication Data

US 2002/0088625 A1 Jul. 11, 2002

Related U.S. Application Data

(62) Division of application No. 09/166,991, filed on Oct. 6, 1998.

(51) Int. Cl.[7] ..... A62C 3/07; A62C 3/08; A62C 35/02

(52) U.S. Cl. ..... 169/62; 169/64; 169/70

(58) Field of Search ..... 169/51, 62, 64, 169/70, 9, 68, 52, 24, 43, 45, 46

(56) References Cited

U.S. PATENT DOCUMENTS 4,593,855 A * 6/1986 Forsyth ..... 239/74
5,161,621 A * 11/1992 Shlomo ..... 169/46
5,553,673 A * 9/1996 Hackman ..... 169/24
5,590,718 A * 1/1997 Bertossi ..... 169/62
5,899,276 A * 5/1999 Relyea et al. ..... 169/24
5,908,074 A * 6/1999 Potts ..... 169/60
5,934,379 A * 8/1999 Ostlyngen et al. ..... 169/46
6,378,617 B1 * 4/2002 Brennan ..... 169/62

* cited by examiner

*Primary Examiner*—Davis Hwu
(74) *Attorney, Agent, or Firm*—John J. Elnitski, Jr.

(57) ABSTRACT

The present invention provides an apparatus and method for the protection of off-road vehicles, such as ladle carriers, pot carriers, slag carriers and front end loaders which are used in high heat or flammable environments. The present invention prevents and/or limits damage from radiant heat, provides for the extinguishment of fires, provides a level of protection to the vehicle operator, and provides for the operator's escape from the vehicle at the onset of a fire or high heat incident. The apparatus and method of this invention implements the use of a liquid surfactant based wetting agent. The wetting agent is formulated to prevent radiant and ambient heat damage to the vehicle from radiant heat, flame and splashing of molten material on the vehicle. The wetting agent can be made to be environmentally safe. The present invention provides an increased level of safety to the operator, should the operator be required to escape from the vehicle in the event of a fire or high heat incident. The apparatus of the present invention includes four components that provide a total protection system for off-road vehicles to address specific areas of the vehicle. The specific areas include the tires, the hydraulic lines, the hydraulic pump and motor compartment. Should a fire occur in a specific area of the vehicle, the operator is able to independently activate a specific area protection system component to address that precise fire or heat damage problem in that specific area.

19 Claims, 8 Drawing Sheets

APPARATUS AND METHOD FOR OFF-ROAD VEHICLE FIRE PROTECTION AND FIRE SUPPRESSION

This application is a divisional patent application of and claims priority to U.S. patent application Ser. No. 09/166,991 filed Oct. 6, 1998.

BACKGROUND

For many years fire suppression and extinguishing systems have protected motor vehicles, railcars and aircraft. In the last two decades, fire suppression systems have been affixed to off-road vehicles used to transport molten slag and steel, as well as vehicles used in the mining industry. Examples of such vehicles are front end loaders, ladle carriers and pot carriers.

The fire suppression systems available for these off-road vehicles have been limited to the use of dry chemical powder materials to extinguish a fire when it occurs. One example of a fire suppression system is a system that pipes the dry chemical powder material to the motor compartment area of these types of vehicles. When the system is activated by the operator, the system discharges all of the stored dry powder chemical agent in its entirety, leaving none to use later. The hydraulic control areas, lines, vehicle tires, and the operator remained unprotected by the current systems. No provision is made to provide for the safe escape of the operator should a fire or high heat situation occur. Also, most dry chemical powders are hazardous to the environment, will not prevent surfaces from supporting combustion and will not rapidly cool superheated materials.

It is an object of the present invention to provide an apparatus and method for preventing and suppressing fire damage to a vehicle which operates in a high heat and flammable environment.

It is another object of the present invention to provide an apparatus and method for protecting an operator of a vehicle which operates in a high heat and flammable environment.

SUMMARY OF THE INVENTION

The present invention is a fire suppression and heat protection system for a vehicle. The system includes a fire suppression unit for preventing and extinguishing a fire; a fire escape unit for providing a safe escape path from the vehicle for an operator of the vehicle; a operator cab protection unit for protecting the operator while in a cab of the vehicle; and a tire protection unit for protecting tires of the vehicle during operation of the vehicle in hot and flammable environments. Each unit utilizes a liquid surfactant based wetting agent to extinguish fire and protect the operator and vehicle from fire and heat.

DESCRIPTION OF THE INVENTION

Figure 1:
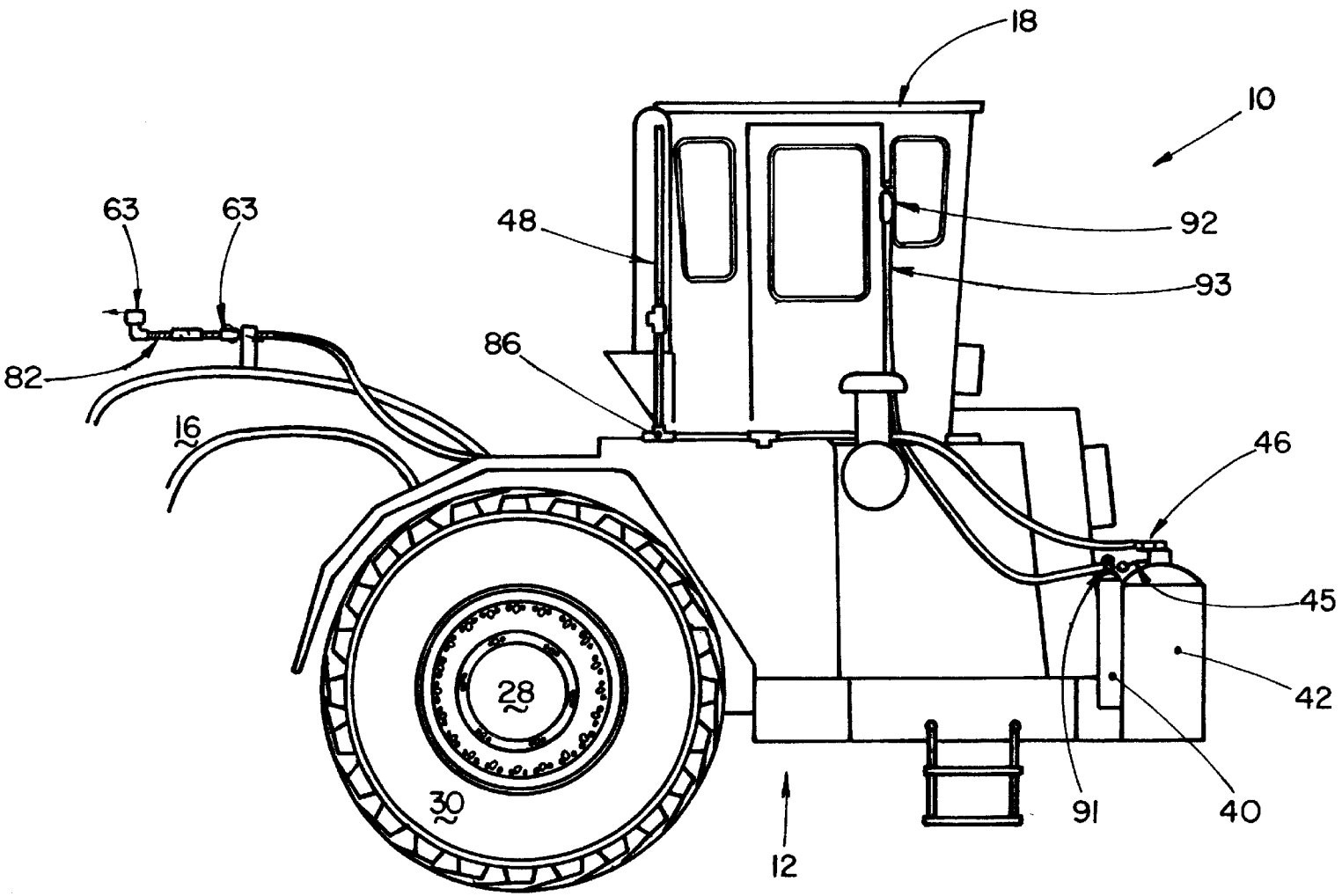
FIG. 1 is a side view of a vehicle with a fire suppression unit according to the present invention.
Figure 2:
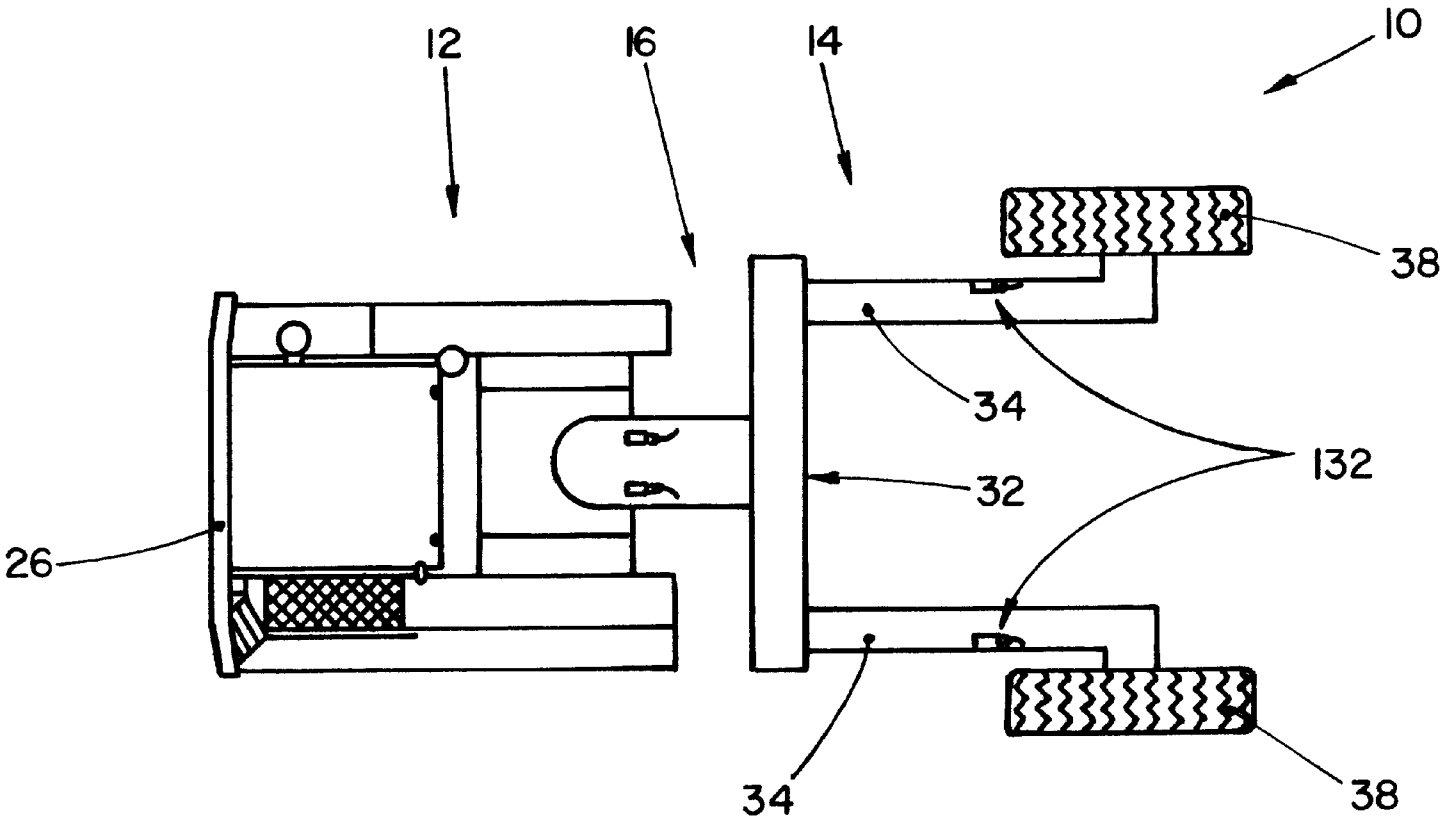
FIG. 2 is a top view of a vehicle with a tire protection unit according to the present invention.

The present invention provides an apparatus and method for the protection of off-road vehicles, such as ladle carriers, pot carriers, slag carriers and front end loaders which are used in high heat or flammable environments. The present invention prevents and/or limits damage from radiant heat, provides for the extinguishment of fires, provides a level of protection to the vehicle operator, and provides for the operator's escape from the vehicle at the onset of a fire or high heat incident.

One type of off-road vehicle 10 is shown in FIGS. 1–4 and 6–8. The vehicle 10 includes a front section 12, rear section 14 and a neck 16 which connects the front and rear sections 12, 14. The front section 12 includes an operator cab 18, motor compartment 20, hydraulic lines (not shown), hydraulic pump (not shown), ladder 22, catwalk 24, front end 26 and front wheels 28 with tires 30. The motor compartment 20 houses a motor (not shown) and transmission (not shown) which drives the front wheels 28. The rear section 14 includes a main frame 32, arms 34 and rear wheels 36 with tires 38. Arms 34 extend from the main frame 32 and are used to transport the ladles and pots of molten slag and steel, as well other hot materials used in the mining industry. The neck 16 is a frame which allows the front section 12 to pivot in relation to the rear section 14 and provides a path for the necessary hydraulic lines to operate the arms 34. The vehicle 10 is put in constant danger of fire and heat damage. This is especially true for the rear tires 38, which are closest to the heat and fire sources, when picking up a hot ladle or pot.

The apparatus and method of this invention implements the use of a liquid surfactant based wetting agent. The wetting agent is formulated to prevent radiant and ambient heat damage to the vehicle 10 from radiant heat, flame and splashing of molten material on the vehicle 10. The wetting agent can be made to be environmentally safe. The present invention provides an increased level of safety to the operator, should the operator be required to escape from the vehicle 10 in the event of a fire or high heat incident. The apparatus of the present invention includes four components that provide a total protection system for off-road vehicles to address specific areas of the vehicle 10. The specific areas include the tires 30, 38, the hydraulic lines, the hydraulic pump and motor compartment 20. Should a fire occur in a specific area of the vehicle 10, the operator is able to independently activate a specific area protection system component to address that precise fire or heat damage problem in that specific area.

The first component is a fire suppression unit, as shown in FIGS. 1, and 3–5. The fire suppression unit protects the motor compartment 20, hydraulic lines and the hydraulic pump of the vehicle 10 from damage caused by radiant heat, flame and splashed molten material. The fire suppression unit includes a high pressure cylinder 40, a reservoir tank 42, hoses 45–48, 50–52, nozzles 60, 62–65 and an activation system. The pressure cylinder 40 provides pressure via a hose 45 to the reservoir tank 42 which contains the wetting agent. The pressure cylinder 40 usually contains a gas such as nitrogen to pressurize the reservoir tank 42. The gas is transferred to the reservoir tank 42 using the hose 45. As the gas is transferred to the reservoir tank 42, the wetting agent is forced out of the reservoir tank 42 and disbursed through hoses 47–48, 50–52 and nozzles 60, 62–65 using the main hose 46.

Figure 3:
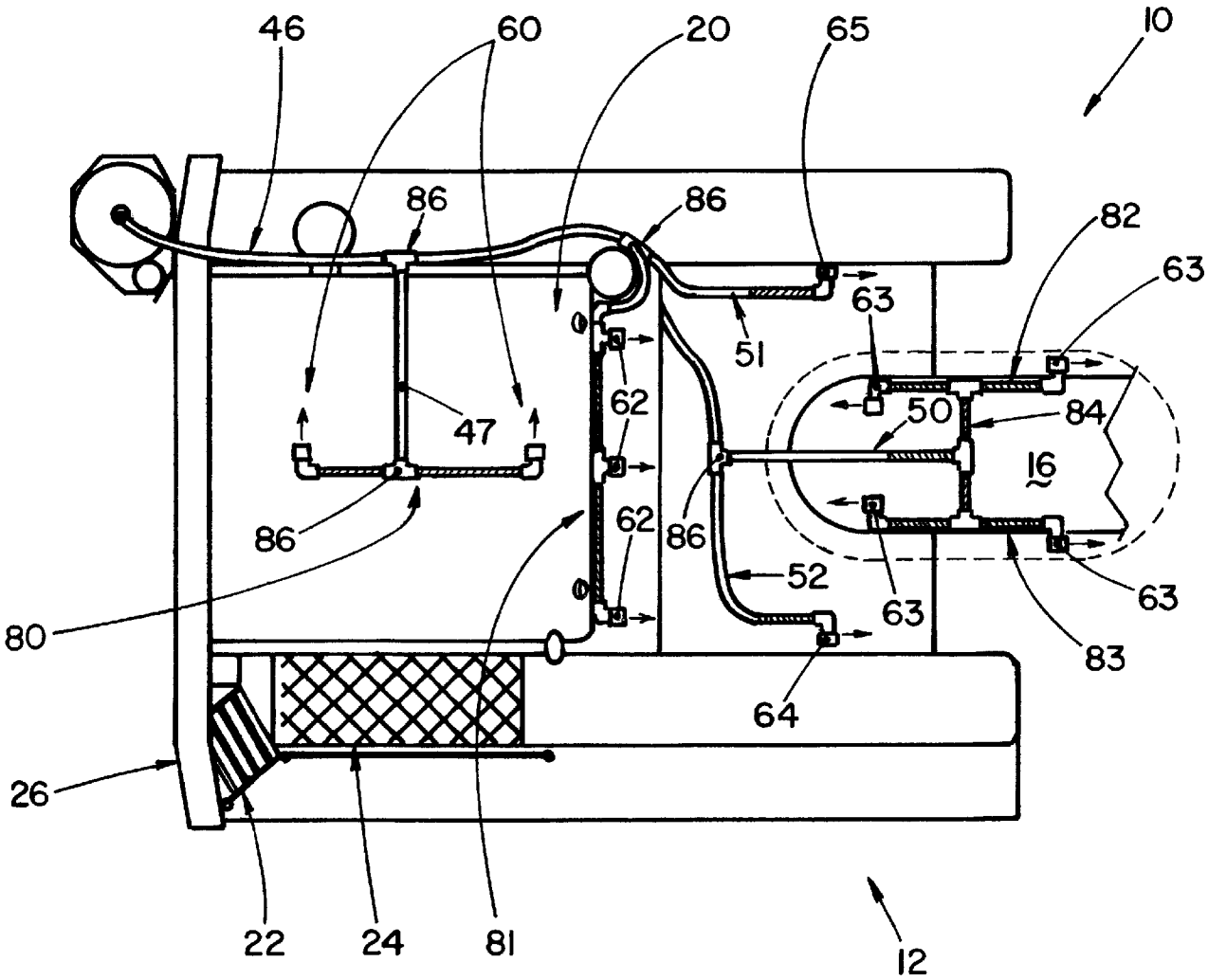
FIG. 3 is a top view of the vehicle with the fire suppression unit of FIG. 1 according to the present invention.
Figure 4:
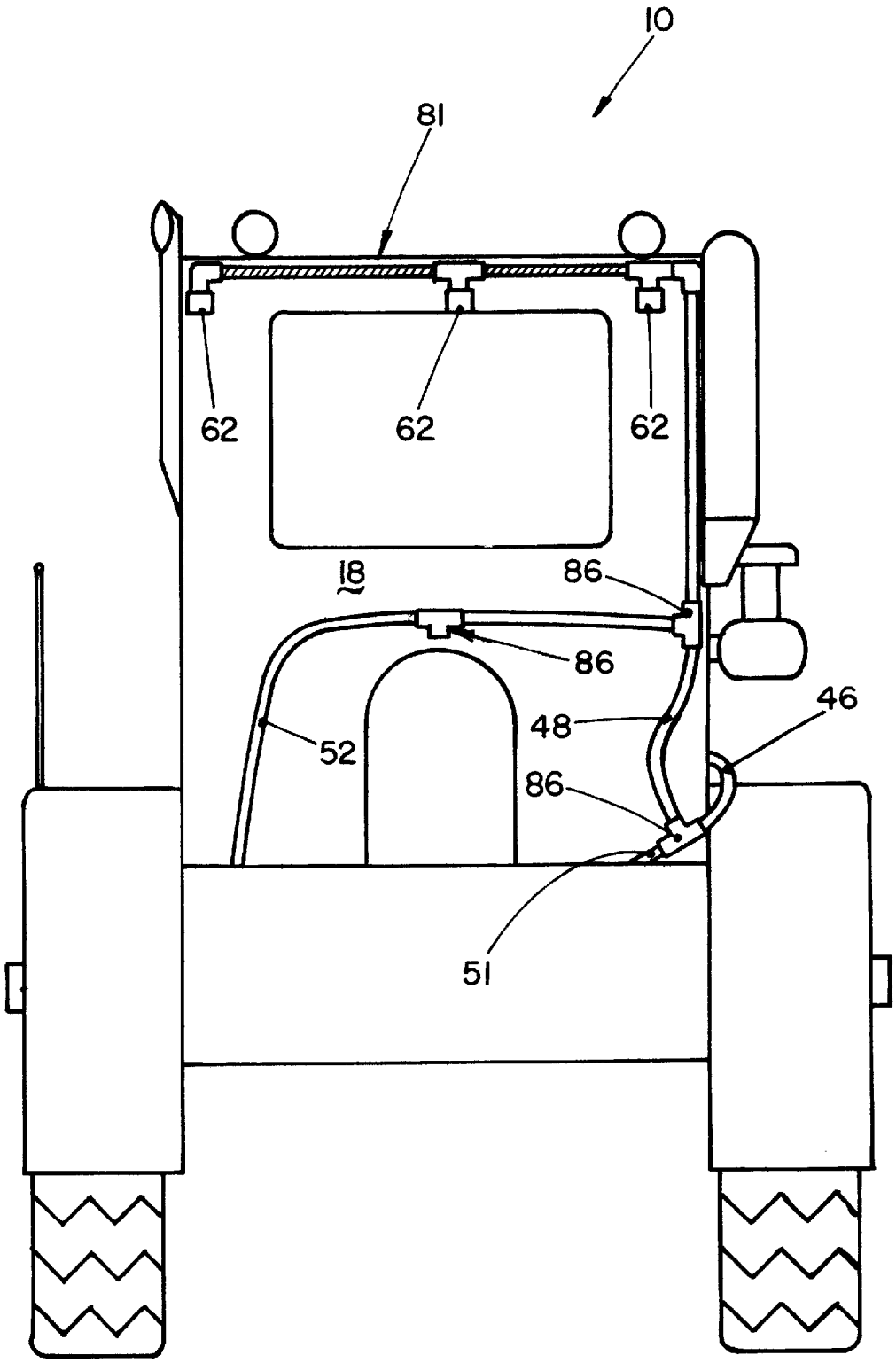
FIG. 4 is a rear view of the vehicle with the fire suppression unit of FIG. 1 according to the present invention.

The nozzles 60, 62–63 are mounted on spray bars 80–83, which are strategically placed to cover the motor compartment 20, hydraulic lines and hydraulic pump. Spray bar 80 is mounted in the motor compartment 20 directly over the motor. The spray bar 80 is connected to the main hose 46 using a tee fitting 86 and hose 47. The nozzles 60 on spray bar 80 are pointed downward towards the motor. Spray bar 81 is mounted along the rear roof line of the vehicle 10, as shown in FIGS. 3–4. The nozzles 62 of spray bar 81 are pointed downward towards the rear of the vehicle 10 for coverage of any fire or heat emanating from the neck 16 or the rear section 14 of the vehicle 10. Spray bar 81 is connected to the main hose 46 using a tee fitting 86 and hose 48. Spray bars 82 and 83 are for the protection of the hydraulic lines and hydraulic pump. Spray bar 82 and 83 are interconnected to form an H-shaped unit having four nozzles 63. Spray bars 82 and 83 are mounted on the neck 16 of the vehicle 10, near the pivot point. The nozzles 63 of spray bars 82 and 83 are pointed downward towards the hydraulic lines and hydraulic pump located at the rear of the front section 12 and towards rear section 14 of the vehicle 10. Spray bars 82 and 83 are connected together by spray bar 84 and tee fittings 86. Hose 49 connects spray bar 84 to hose 50. Hose 50 is connected to the main hose 46 using tee fittings 86. Spray nozzles 64–65 are positioned and aimed rearward of the cab 18 to provide additional protection to the rear of the vehicle 10 and the hydraulic lines along the neck 16. The nozzle 64 is supplied by hose 51, which is connected to the main hose 46 through the tee fitting 86. The nozzle 65 is supplied by hose 52, which is connected to the main hose 46 through the tee fitting 86.

Figure 5:
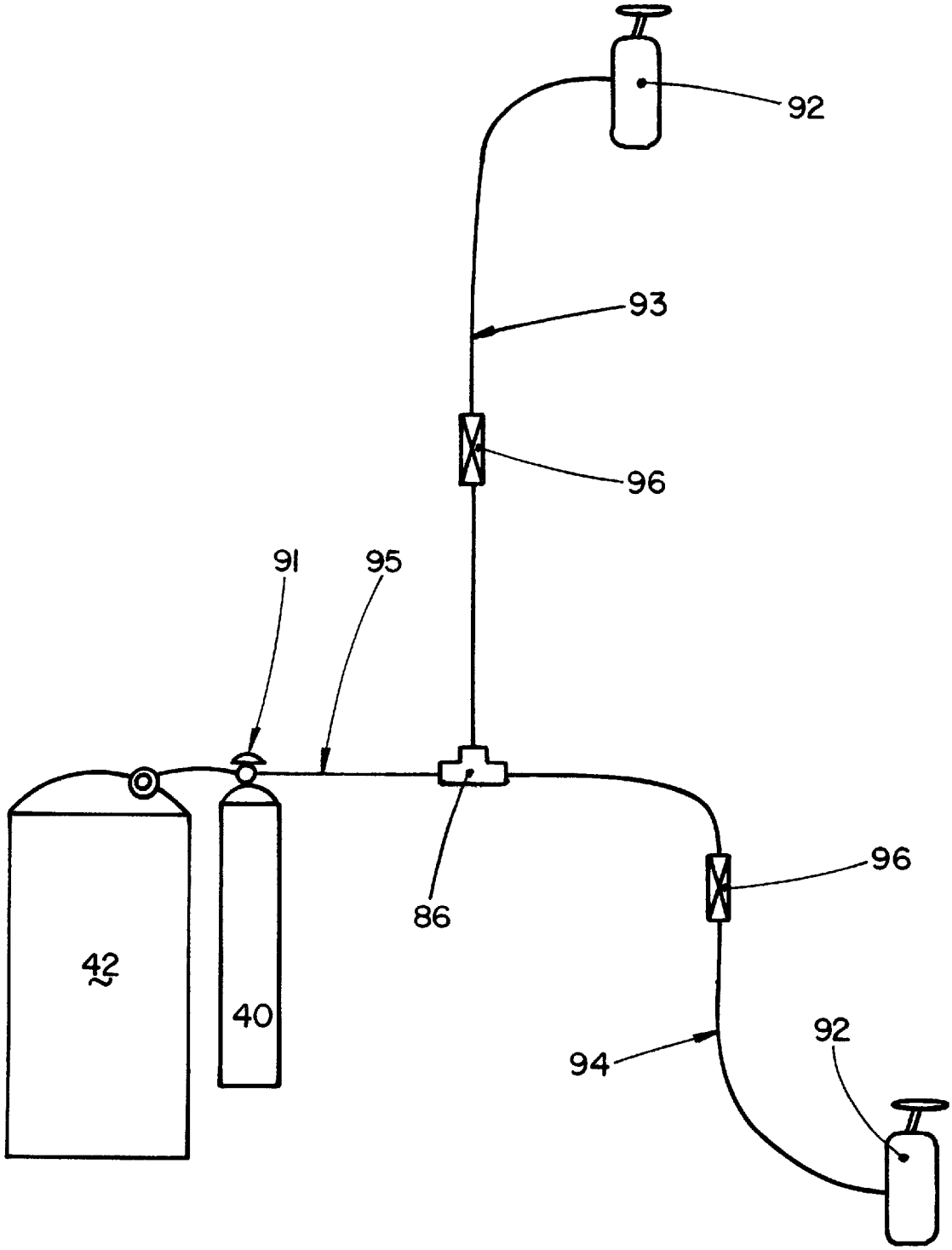
FIG. 5 is a schematic of the fire suppression unit of FIG. 1 according to the present invention.

The fire suppression unit is activated from one of the following three positions. The first position (not shown) is mounted in the cab 18, so that the operator may activate the system during operation of the vehicle 10. The second position (not shown) is at ground-level of the vehicle 10, normally near the front end 26 at the bottom of the ladder 22 of the vehicle 10. The third position is at the location of the high pressure cylinder 40. At the third position is a pneumatic valve actuator 91, which can be manually activated. The activation of the pneumatic valve actuator 91 releases the gas from the cylinder 40 and pressurizes the reservoir tank 42. The wetting agent is forced to flow through the nozzles 60, 62–65, due to the pressurization of the tank 42. At the first and second positions are an actuator 92, as shown in FIG. 5. The acuator 92 includes an actuator gas cartridge (not shown) and hoses 93 and 94, respectively of the first and second positions. The hoses 93 and 94 connect to a tee fitting 86 and hose 95 extends from the tee fitting 86 to the pneumatic valve actuator 91. A check valve 96 is fitted between each actuator 92 and the tee fitting 86. When the system is actuated at either the first or second positions, the gas cartridge is punctured at that position. The gas from the cartridge flows via either hose 93 or hose 94 to the pneumatic valve actuator 91. The gas from the cartridge activates the pneumatic valve actuator 91 of the cylinder 40 and the reservoir tank 42 is pressurized.

Figure 6:
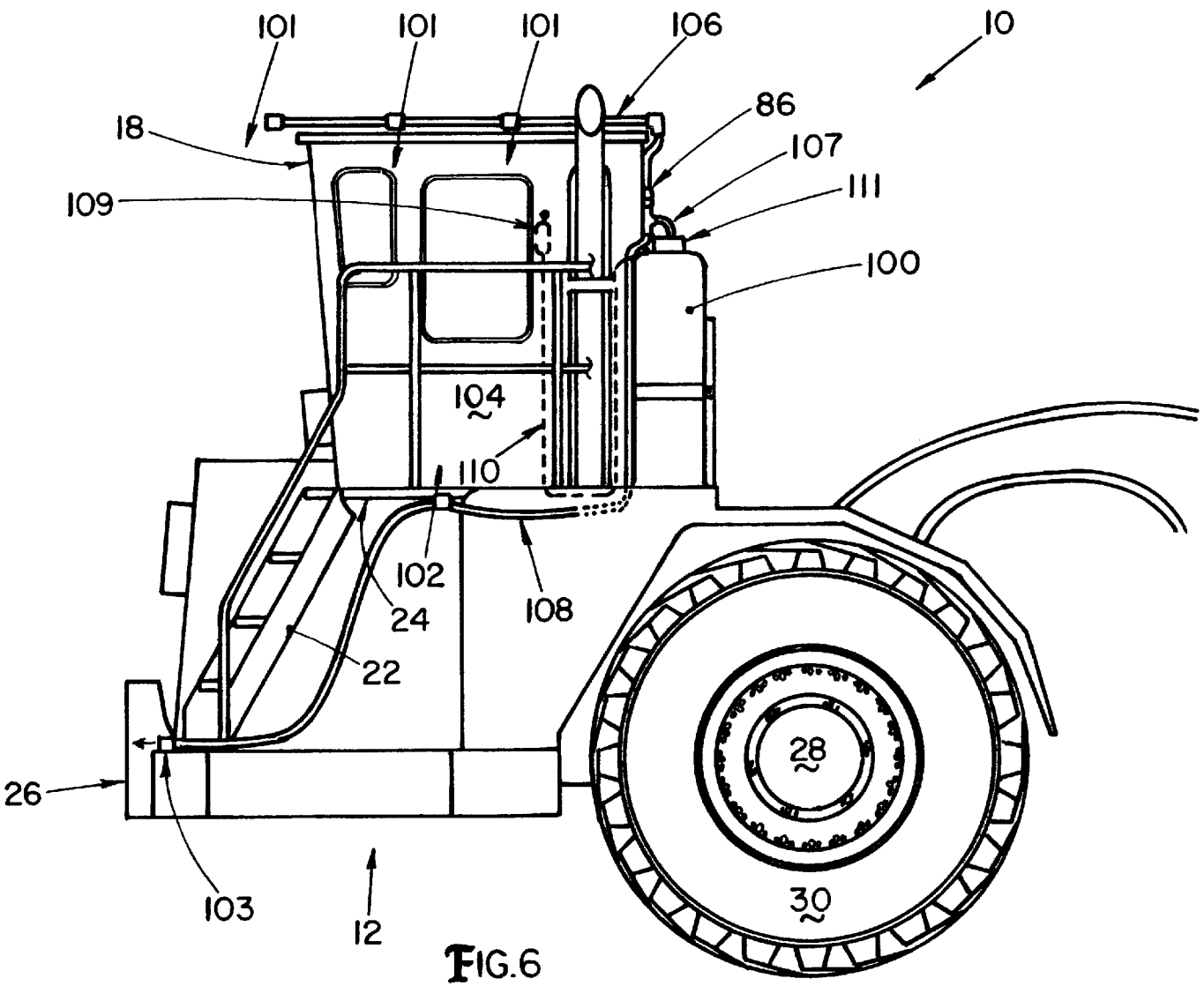
FIG. 6 is a side view of a vehicle with a fire escape unit according to the present invention.

The second component is a fire escape unit, as shown in FIG. 6. A review of previous fire event injuries indicates that those operators suffered bum injuries about their inner thigh and genital areas from the heat radiating from below. The fire escape unit helps in preventing these injuries. The fire escape unit releases the wetting agent from a pressurized cylinder 100 and discharges the agent through a series of nozzles 101–103. The nozzles 101 are positioned along the exterior overhead of the operator cab exit door 104, so as to provide for a continuing spray of wetting agent about the operator exit area. The nozzles 102 are positioned, facing upright, below the catwalk 24, immediately outside the operator cab exit door 104. The nozzles 102 discharge wetting agent upward into the crotch area of the operator as the operator exits the cab 18 along the catwalk 24. Additional nozzles 103 are positioned near ground level at bottom area of the ladder 22 and provide spray about the ladder 22 and front end 26 of the vehicle. The nozzles 101–103 are positioned in such a manner so as to distribute the wetting agent in a fogging spray pattern about the areas of the operator cab exit door 104, catwalk 24 and ladder 22. This distribution of wetting agent is directed in such a manner so as to cover and soak the operator with the wetting agent as the operator exits the cab 18, descends from the vehicle 10 via the ladder 22.

The pressurized cylinder 100 of the escape unit contains wetting agent. The pressurized cylinder 100 is mounted to rearward of the cab 18 and near the exit door 104. A spray bar 106 is mounted overhead of the exit door 104, where the nozzles 101 point downward. Hose 107 is the main hose extending from the pressurized cylinder 100. The spray bar 106 connects to the main hose 107 using tee fitting 86. A hose 108 runs underneath the catwalk 24 from the tee fitting 86 and towards the bottom of the vehicle 10 near the bottom of the ladder 22. The nozzle 102 is mounted under the catwalk 24 and connected to hose 108. The nozzle 102 points upward to spray up through the catwalk 24 and towards the operator crotch area during escape. The nozzle 103 is mounted near ground level and the bottom of the ladder 22, where it is aimed to provide spray around the front end 26 and ladder 22 of the vehicle 10. All of the nozzles 101–103 are aimed to provide a fog pattern about the escape path of the operator. The fire escape unit is manually activated by the operator, once the decision to flee the vehicle is made. The escape unit is actuated manually by the operator using an actuator 109 which includes an actuator gas cartridge (not shown) and hose 110. The hose 110 connects a pneumatic valve actuator 111 on the cylinder 100. When the unit is actuated, the gas cartridge is punctured and the gas from the cartridge flows via hose 110 to the pneumatic valve actuator 111. The gas for the cartridge activates the pneumatic valve actuator 111 and the wetting agent flows through the nozzles 101–103. A motor shut down switch (not shown) can be connected to the actuator 109 to provide for the automatic shut down of the motor, when the operator needs to escape.

Figure 7:
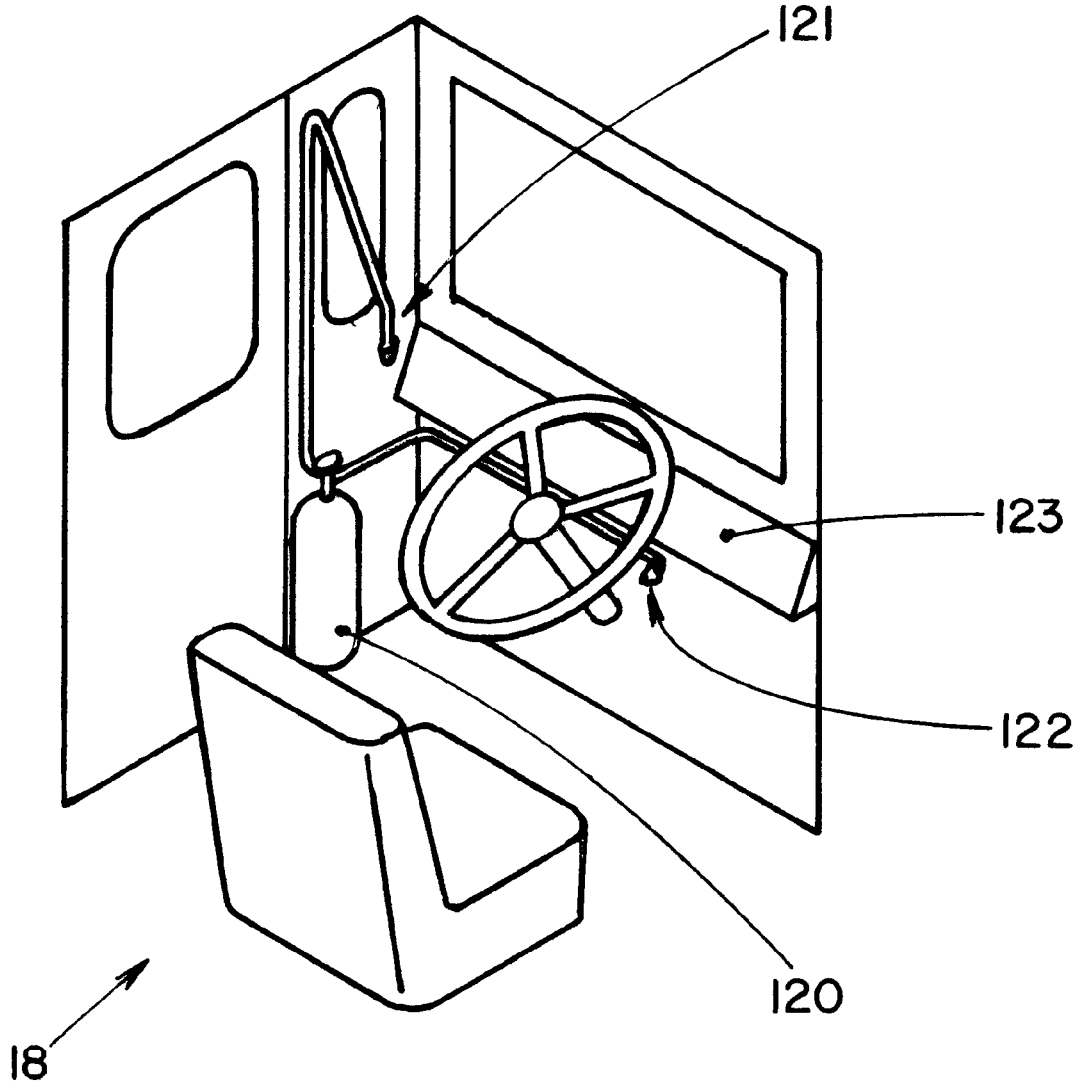
FIG. 7 is a perspective top view of a vehicle with a operator cab protection unit according to the present invention.

The third component is an operator cab protection unit mounted in the interior area of the operator cab 18, as shown in FIG. 7. The cab protection unit includes a single pressurized cylinder 120 inside the cab 18, which is filled with the wetting agent. Nozzles 121 connected to cylinder 120 are positioned inside the cab 18 and overhead of the operator, so as to soak the operator from above. Another nozzle 122 connected to the cylinder 120 is positioned below the dashboard area 123 and aimed so as to discharge wetting agent into the crotch area of the seated operator. The wetting agent is discharged in this manner so as to protect the operator from radiant heat and flame. The cab protection unit also provides a level of protection for knocking down flame and reducing heat in the interior of the cab 18 should the operator be trapped inside. The activation of the spraying of the wetting agent from the cylinder 120 can be done as described above for the fire escape unit or could be the simple turning of a valve on the cylinder 120.

Figure 8:
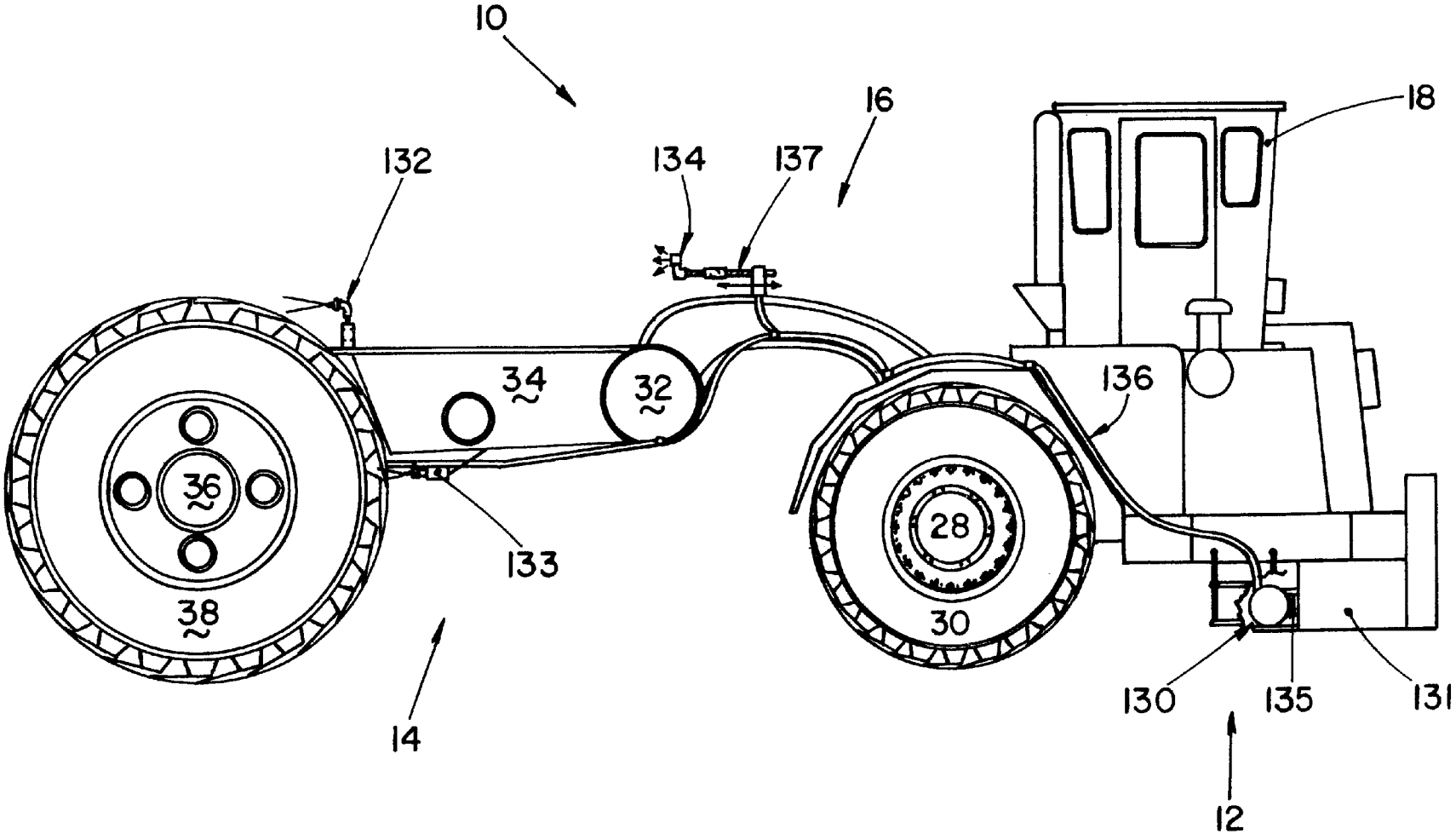
FIG. 8 is a side view of a vehicle with a tire protection unit according to the present invention.

The fourth component is a tire protection unit, as shown in FIG. 8. The tire protection unit includes a manually activated pump 130, which transfers a quantity of the wetting agent from a holding tank 131 to strategically placed nozzles 132–134 via metal lines or hoses 135–136. The nozzles 132–134 provide a spray of wetting agent to the rear tires 38 and hydraulic lines of the rear section 14 of the vehicle 10 during operation of the vehicle 10 in high heat situations. The wetting agent protects the rear tires 38 and hydraulic lines from radiant heat and flame, prevents charring and combustion of the tires 38 and hydraulic lines, and cools molten materials which contact the rear tires 38 and hydraulic lines during normal vehicle operation. The pump 130 and tank 131 are shown mounted below the front of the vehicle 10 for easy access and re-filling. A main tank hose 135 runs from the tank 131 to the pump 130. A pump hose 136 runs rearwardly along the vehicle 10 to supply the series of nozzles 132–134 with wetting agent. Generally, there are four nozzles 132–133 mounted to spray the rear tires 38 of the vehicle 10, whereby there are two nozzles 132–133 per tire 38. Nozzles 132 are usually pointed at the treadface of the tire 38. Nozzles 133 are usually pointed at the inner side walls of the tires 38. Additional nozzles (not shown) can be added to provide more coverage of the rear tires 38. Intended use of the tire protection unit is daily, during the movement of hot molten materials by the vehicle 10. Also included is a spray bar 137 at neck 16 with nozzles 134 aimed to spray hydraulic lines of the rear section 14 and the neck 16. The spray bar 137 is the same bar as the spray bars 82 and 83 of the fire suppression unit and is described if the fire suppression unit is not installed on the vehicle 10. If the fire suppression unit is installed with the tire protection unit, the spray bars 82 and 83 would be supplied by the two wetting agent tanks 42, 131 of the both units. The tire protection unit is activated by operator by switching on the pump 130 from switches (not shown) mounted on inside of the cab 18, within reach of the seated operator.

While different embodiments of the invention has been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A fire suppression and heat protection system for a vehicle comprising:

a fire suppression unit for preventing and extinguishing a fire;

a fire escape unit along an exit path of the vehicle that sprays a liquid wetting agent on an escaping operator, in order to provide a safe escape path from the vehicle for the operator of the vehicle, wherein said fire escape unit is a system of at least one nozzle to spray said liquid wetting agent and a source of said liquid wetting agent to supply said at least one nozzle; and wherein said exit path is a prearranged path along the vehicle for exiting a cab of the vehicle which runs from the cab to ground level; and an operator cab protection unit for protecting said operator while in a cab of the vehicle.

2. The system of claim 1, wherein said fire escape unit includes at least one nozzle mounted above and pointed downward along said exit path of the operator, and at least one nozzle underneath and pointed upward along said exit path of the operator; and wherein said nozzles of said fire escape unit spray a protective spray of wetting agent on said operator during escape from said vehicle.

3. The system of claim 1, wherein a liquid surfactant based wetting agent is used with each of said units to extinguish fire and protect said operator and vehicle from fire and heat.

4. The system of claim 1, wherein said fire suppression unit includes a reservoir tank of suppressant material to suppress fire, a pressurized tank of gas for pressurizing said reservoir tank and forcing said suppressant material from said reservoir tank, nozzles positioned about said vehicle and hoses connecting said reservoir tank with said nozzles for the transfer of said suppressant material from said reservoir tank to said nozzles.

5. The system of claim 1, wherein said operator cab protection unit includes at least one nozzle pointed upward at a crotch area of the operator in said cab, and wherein said nozzles of the operator cab protection unit provides a protective spray of wetting agent on the operator while in said cab.

6. The system of claim 1, wherein said operator cab protection unit includes at least one nozzle overhead the operator for spraying the operator with said agent.

7. The system of claim 6, wherein said operator cab protection unit includes at least one nozzle overhead the operator for spraying the operator with said agent.

8. The method of claim 1, wherein at least one nozzle is positioned underneath said path spraying said agent upward upon the operator during escape of the operator.

9. The method of claim 1, wherein said nozzles provide a foggy spray pattern of said agent to protect the operator during escape along said path.

10. The system of claim 1, wherein said vehicle operates in high heat and flammable environments; wherein said vehicle includes a front section, rear section and a neck connecting said front and rear sections; wherein said front section includes an operator cab, motor compartment, hydraulic lines, hydraulic pump, ladder, catwalk, and front end; wherein said motor compartment houses a motor and transmission; wherein said rear section includes a main frame, arms, rear wheels and tires; and wherein said arms extend from said main frame and are used to transport ladles and pots of molten slag and steel, as well other hot materials used in the mining industry.

11. The system of claim 10, wherein said operator cab protection unit includes at least one nozzle pointed upward at a crotch area of the operator in said cab, and wherein said nozzles of the operator cab protection unit provides a protective spray of wetting agent on the operator while in said cab.

12. The system of claim 10, wherein said fire escape unit includes at least one nozzle mounted above and pointed downward along an exit path of the operator, and at least one nozzle underneath and pointed upward along said exit path of the operator; and wherein said nozzles of said fire escape unit spray a protective spray of wetting agent on said operator during escape for said vehicle.

13. An apparatus for protecting an operator of a vehicle during escape from the vehicle comprising a fire escape unit along an exit path of the vehicle that sprays a liquid wetting agent on an escaping operator, in order to provide a safe escape path from the vehicle for the operator of the vehicle, wherein said exit path is a prearranged path along the vehicle for exiting a cab of the vehicle which runs from the cab to ground level.

14. The system of claim 13, wherein said fire escape unit includes at least one nozzle mounted above and pointed downward along said exit path of the operator, and at least one nozzle underneath and pointed upward along said exit path of the operator; and wherein said nozzles of said fire escape unit spray a protective spray of wetting agent on said operator during escape from said vehicle.

15. The method of claim 13, wherein at least one nozzle is positioned underneath said path spraying said agent upward upon the operator during escape of the operator.

16. The method of claim 13, wherein said nozzles provide a foggy spray pattern of said agent to protect the operator during escape along said path.

17. The system of claim 13, wherein said vehicle operates in high heat and flammable environments; wherein said vehicle includes a front section, rear section and a neck connecting said front and rear sections; wherein said front section includes an operator cab, motor compartment, hydraulic lines, hydraulic pump, ladder, catwalk, and front end; wherein said motor compartment houses a motor and transmission; wherein said rear section includes a main frame, arms, rear wheels and tires; and wherein said arms extend from said main frame and are used to transport ladles and pots of molten slag and steel, as well other hot materials used in the mining industry.

18. The system of claim 17, wherein said fire escape unit includes at least one nozzle mounted above and pointed downward along an exit path of the operator, and at least one nozzle underneath and pointed upward along said exit path of the operator; and wherein said nozzles of said fire escape unit spray a protective spray of wetting agent on said operator during escape for said vehicle.

19. The method of claim 17, wherein said nozzles provide a foggy spray pattern of said agent to protect the operator during escape along said path.

* * * * *